US009972289B2

(12) United States Patent
Artino

(10) Patent No.: US 9,972,289 B2
(45) Date of Patent: May 15, 2018

(54) TUNE STABILIZING DEVICE FOR A STRINGED INSTRUMENT

(71) Applicant: Anthony P. Artino, Hudson, OH (US)

(72) Inventor: Anthony P. Artino, Hudson, OH (US)

( * ) Notice: Subject to any disclaimer, the term of this patent is extended or adjusted under 35 U.S.C. 154(b) by 0 days. days.

(21) Appl. No.: 14/928,492

(22) Filed: Oct. 30, 2015

(65) Prior Publication Data

US 2016/0307547 A1 Oct. 20, 2016

Related U.S. Application Data

(63) Continuation-in-part of application No. 13/970,894, filed on Aug. 20, 2013, now Pat. No. 9,208,757.

(60) Provisional application No. 61/783,102, filed on Mar. 14, 2013.

(51) Int. Cl.

| | |
|---|---|
| ***G10D 3/12*** | (2006.01) |
| ***G10D 3/14*** | (2006.01) |
| ***G10D 1/08*** | (2006.01) |

(52) U.S. Cl.

CPC ..... *G10D 3/14* (2013.01); *G10D 1/085* (2013.01)

(58) Field of Classification Search

CPC ..... G10D 3/14
USPC ..... 84/303, 297 R
See application file for complete search history.

(56) References Cited

U.S. PATENT DOCUMENTS 4,475,432 A 10/1984 Stroh
4,574,678 A * 3/1986 Edwards ..... G10D 3/12 24/134 R
4,667,561 A 5/1987 Storey et al.
RE32,863 E 2/1989 Edwards
4,878,413 A * 11/1989 Steinberger ..... G10D 3/14 84/312 R
5,456,151 A 10/1995 Enserink
5,932,822 A 8/1999 Bernstein
5,986,192 A 11/1999 Wingfield et al.
6,700,043 B2 3/2004 Hirayama
6,703,546 B1 3/2004 Wilson
6,806,411 B1 * 10/2004 Allen ..... G10D 3/14 84/454
6,812,389 B2 11/2004 Trooien
(Continued)

FOREIGN PATENT DOCUMENTS

EP 0249464 A2 12/1987
EP 0626673 A2 11/1994
WO WO9006571 A1 6/1990

OTHER PUBLICATIONS

Reynald Chaput, www.sta-tuned.com, String Lock for Electric Guitars, 2013.

(Continued)

*Primary Examiner* — Jianchun Qin
(74) *Attorney, Agent, or Firm* — George W. Moxon, II; Brian P. Harrod

(57) ABSTRACT

A tune stabilizing device comprising a string clamping means comprising a floating base plate and a clamping means adapted to cooperatively engage and releasably secure one or more instrument strings, a fine-tuning means, having a plurality of fine tuning screws in one-to-one correspondence with said instrument strings, whereby turning one of said screws presses on one of said strings, altering the tune of the string, and a deflection arresting means, capable of preventing said tune stabilizing device from deflecting away from the instrument strings when said fine tuning screws press against said strings.

13 Claims, 12 Drawing Sheets

(56) References Cited

U.S. PATENT DOCUMENTS

| | | | | |
|---|---|---|---|---|
| 6,933,430 | B2 * | 8/2005 | Oskorep | G10D 3/163 84/320 |
| 7,145,065 | B2 | 12/2006 | Geier | |
| 7,427,703 | B2 | 9/2008 | Geier | |
| D646,710 | S | 10/2011 | Chaput | |
| 8,536,430 | B2 * | 9/2013 | McCabe | G10D 3/14 84/312 R |

OTHER PUBLICATIONS

Reynald Chaput, String Lock for Jazz Style Electric Guitars, http://www.sta-tuned.com/electric-guitar-systems/j-style-system.html, Oct. 2011.

Fender USA, Fine Tune Lock Nut for Stratocaster, https://reverb.com/item/512244-rare-1980s-fender-usa-tine-tune-lock-nut-locking-tuners-for-stratocaster, 1984.

Floyd Rose, www.floydrose.com, Electric guitar tremelo system, 2015.

* cited by examiner

TUNE STABILIZING DEVICE FOR A STRINGED INSTRUMENT

CROSS REFERENCE TO RELATED APPLICATIONS

This application is a continuation-in-part of, and claims the benefit of, U.S. patent application Ser. No. 13/970,984, filed Aug. 20, 2013, which is entitled "Tune Stabilizing Device for a Stringed Instrument," and is incorporated herein by reference.

BACKGROUND OF THE INVENTION

It is known to have precisely tensioned wires in a wide variety of contexts including musical instruments such as guitars. With particular regard to electric guitars, it is known to equip such an instrument with a tremolo system allowing the user to radically and quickly fluctuate the tension in the strings. Furthermore, such variation is known to cause the string tension to change even after the tremolo is relaxed, i.e. the instrument goes out of tune.

One component of this change in tension is due to the strings hanging up on the nut of the guitar. It is known to use lubricants on the nut to prevent such hang ups; however, this is also known to be an imperfect solution which merely mitigates rather than eliminates the tendency to go out of tune. It also tends to be a messy and short-lived solution.

Clamps have been installed in guitars which typically are bolted to the instrument, replacing the nut. This can be effective, but it requires radically and irreversibly modifying the instrument. This is undesirable to many musicians, and may be unacceptable in the case of particularly valuable or collectible instruments. Even when a clamp is installed, the user is inconvenienced because he must compensate for the fact that the string tension is affected by the clamping process. Therefore, in order to maintain perfect tuning pitch, the musician must install a tremolo system, or a tail piece, which houses a fine-tuner system. Similar to installing a clamp, it may not be desirable to install a new tremolo system and may require milling or otherwise irreversibly modifying the instrument.

What is needed is a device which helps to prevent an instrument from going out of tune, while not requiring physically altering the instrument. Some embodiments of the present invention may provide one or more benefits or advantages over the prior art.

SUMMARY OF THE INVENTION

A tune stabilizing device comprising a string clamping means comprising a floating base plate and a clamping means adapted to cooperatively engage and releasably secure one or more instrument strings, a fine-tuning means, having a plurality of fine tuning screws in one-to-one correspondence with said instrument strings, whereby turning one of said screws presses on one of said strings, altering the tune of the string, and a deflection arresting means, capable of preventing said tune stabilizing device from deflecting away from the instrument strings when said fine tuning screws press against said strings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF THE INVENTION

Figure 1A:
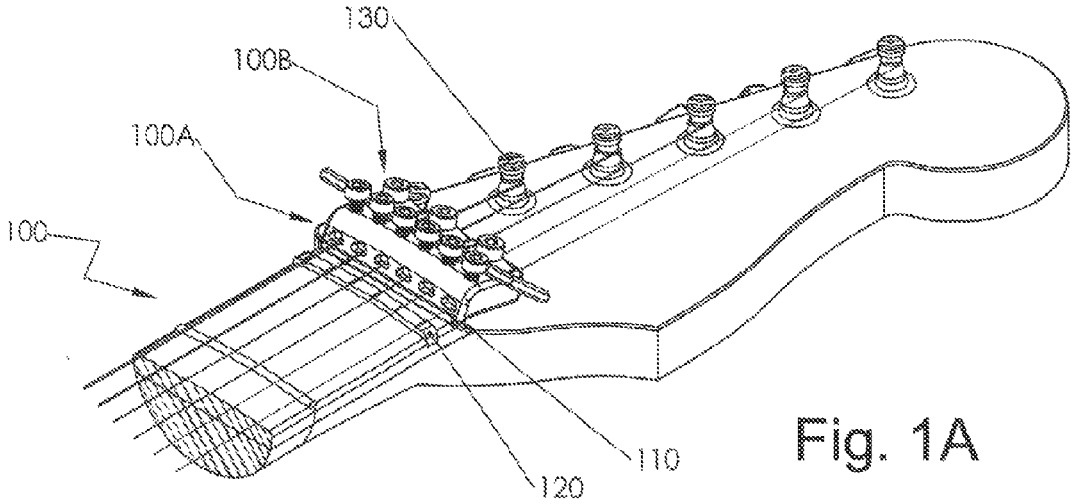
FIG. 1A is a perspective view of the present invention mounted against the leading edge of the fret board of a guitar.

The present invention relates to a device for clamping and tuning the strings on an instrument. According to some embodiments, such a device may include a base plate and one or more clamping blocks mountable thereto. The clamping blocks may be adapted to develop a clamping force between a surface of the clamping blocks and a surface of the base plate such that one or more instrument strings or tensioned wires may be held between the clamping blocks and the base plate in a fixed relation. In this context, a fixed relation includes a lack of any relative motion between the instrument strings, and the clamping blocks and base plate. Furthermore, the device can be adapted to abut a predetermined anchor point, such as the nut of an instrument, so as to hold the portion of the instrument strings in contact with the device in a fixed position relative to the anchor point. As used herein, the terms tensioned wires, wires, strings, and instrument strings may be used interchangeably.

Embodiments disclosed herein are largely described in terms of stringed musical instruments. However, one skilled in the art will appreciate that the invention is not limited to stringed musical instruments which represent only one of many applications. Embodiments of the invention may also find application in any technical area where wires must be maintained at a precise tension despite large or violent transient fluctuations in tension.

The tune stabilizing device might include a base plate having a generally planar compression face. In this context, the term generally planar can include exactly planar surfaces, slightly arched surfaces, and/or knurled or textured surfaces. The base plate can be a floating base plate, meaning that the base plate is not bolted, glued, affixed, or otherwise mounted to the neck or body of an instrument, which fixes its position. For instance, in the context of a stringed musical instrument, a floating base plate would not be bolted or cemented to the instrument but rather may only make contact with, and/or abut, one or more predetermined instrument surfaces. A "floating" base plate would include a base plate that might touch or rest upon the surface of the instrument, and is able to slide along the surface. Notwithstanding, the device may be clamped to the strings of the stringed instrument and still be within the meaning of floating as used herein. Floating further includes a floating base plate that does not contact the neck, headstock, fret or finger board of the instrument, and is capable of being secured on the strings of a stringed instrument between a nut and a plurality of tuning pegs, and is suspended only by the instrument strings such that it contacts no part of the instrument apart from the strings (see FIG. 1C). The tune stabilizing device could be affixed to the instrument to hold it in place, such as clipping, tying, strapping, gluing, screwing, or bolting it to the neck, headstock, or nut. However, it is preferred to keep the device unaffixed since the fixing means inevitably damages or alters the instrument and most instrument owners, especially those of high end or collectable/vintage instruments, go to great lengths to avoid any such damage or alteration.

A floating base plate may include one or more female threads, which may be adapted to receive a screw such as, without limitation, a machine screw or other suitably threaded screw. In general, such threads may be perpendicular to the compression face of the floating base plate; however, other embodiments may include threads disposed at an oblique angle without departing from the scope of the invention.

Floating base plates may include an abutment surface adapted to abut an arbitrary anchor point so as to hold the portion of the strings in contact with the device in a fixed position relative to the anchor point. An abutment surface may simply be a side of the floating base plate. However, in some embodiments, the abutment surface may be specially adapted to mate with particular anchor points. For instance, in the context of a guitar, a suitable anchor point may be the nut of the guitar or a leading edge of the fret board. In some guitar models, the nut may be about a quarter inch from the leading edge of the fret board, and the strings may be oriented so that the device cannot slide between the strings and the fret board to contact the nut. In such instances, if the nut is the desired anchor point, then the abutment surface may be specially adapted to extend past the leading edge of the fret board. For example, a portion of the abutment surface may or may not abut the leading edge of the fret board, but a relatively thin extension thereof may extend past the leading edge of the fret board through the thin gap between the strings and fret board. Accordingly, the extension may abut the nut such that the nut bears some of the load imposed by tension in the wires. In some embodiments, this relatively thin extension of the abutment surface may comprise a unitary or permanently joined part of the floating base plate, or it may be an optional accessory or attachment.

A clamping block may have a planar compression face. Similar to the floating base plate, a planar compression face in this context may comprise an exactly planar surface, a slightly arched surface, and/or a knurled or textured surface. Notwithstanding, the compression face of the clamping block must mate with that of the floating base plate, and therefore must have a complementary shape. Suitable clamping blocks may include at least one unthreaded through-hole adapted to receive a screw, such as, without limitation, a machine screw or other suitably threaded screw permitting a smooth turning action and precise positioning of the screw. The unthreaded through-hole of the clamping block must be oriented to cooperate with the female threads of the floating base plate so that both may simultaneously receive the same screw. Together, the compression faces of the floating base plate and the clamping block cooperate to receive one or more strings in a clamping relation. As used herein the term clamping relation includes applying a compression force sufficient to fix the position of a work piece, such as instrument strings, relative to the clamping block and floating base plate. Furthermore, as used herein, the term work piece means a thing upon which an embodiment acts and is separate and distinct from the embodiment.

The compression face of the floating base plate may define a recessed clamp seat. The recessed compression face may be partially or completely surrounded by a perimeter wall within the boundaries of which clamping blocks may be received in a mating relation by the compression face of the floating base plate. According to some embodiments, the compression face may include one or more dividing walls which cooperate to divide the compression face into a plurality of discrete clamp seats each receiving one clamping block. In such embodiments, the dividing walls may function to align the clamping blocks according to a preferred orientation.

A perimeter wall may include a plurality of apertures on opposing sections of the perimeter wall, which cooperate to allow the strings to pass therethrough parallel to the compression face of the floating base plate, which impede deflection of the tune stabilizing device, as discussed in greater detail below. For instance, a first set of apertures may be defined in a first perimeter wall section, and a second set of corresponding apertures may be defined in a second perimeter wall section disposed on an opposing side of the compression face of the floating base plate, which permit a single tensioned wired to pass through the pair of cooperating apertures in a straight line.

One skilled in the art will appreciate that the act of applying a clamping force to a set of precisely tensioned wires may change the tension in the wires. Accordingly, the present invention may include a set of fine-tuners for adjusting wire tension after the embodiment has been installed. In one embodiment, a set of fine-tuners is defined by extending the base plate from an upper edge of a perimeter wall so as to define a generally planar surface comprising a fine-tuner plate oriented approximately parallel to the compression face of the floating base plate. The fine-tuner plate may include a plurality of female threaded apertures, each being adapted to receive a fine-tuner screw. Suitable screws may include, without limitation, machine screws or other precisely threaded screws permitting fine control over the position of the screw. Accordingly, the fine-tuner screws and female threaded apertures cooperate to contact and precisely deflect a tensioned wire underlying the fine-tuner plate.

The tune stabilizing device may further comprise an abutment wall extending from the fine-tuner plate at an edge opposing the perimeter wall. The wall may include a plurality of apertures, wherein the apertures may be sized, and their center points may be placed, so as to accommodate a predetermined range of wire spacings. In some embodiments, the apertures in the abutment wall may have a larger radius in a direction generally parallel to the fine-tuner plate, and a shorter radius in a direction generally perpendicular to the fine-tuner plate. Use of the term radius in this context is not intended to limit the shape of such apertures to circular. The shape of the apertures is not critical. Rather the shape of such apertures may be any shape including elliptical or generally oblong. However, for practical manufacturing purposes, a circular or round opening might be preferred due its lowering production costs. As used herein, the term aperture means a hole or opening through a surface, and having a continuous, unbroken perimeter or edge.

An abutment wall may include a bumper member which may function as a cushion between an embodiment and an abutment surface such as a fret board or nut of a musical instrument. Such a cushion may be desirable to protect the musical instrument from damage due to the device pressing against, and/or moving relative to, the instrument. Suitable bumpers may be made from an elastomeric material such as a rubber or Teflon, or similar materials, but in general the bumper material must be softer than the material against which it abuts so as to avoid damaging such material.

One skilled in the art will appreciate that in the context of musical instruments such as guitars, the strings might not lie in a flat plane but rather may lie in a curved or arched plane relative to a fret board or finger board. Accordingly, it may be desirable to have an embodiment wherein the floating base plate, the clamping block(s), their respective compression faces, and/or the apertures through which the strings pass, may be arranged in a corresponding arch which generally tracks the arch of the strings. In other words, the several apertures are not aligned in a straight line, but rather are aligned with respect to each other in a curve or arch (See FIG. 3). This arch matches the radius of the curve of the neck or fret/finger board of the instrument, which also matched the curved plane of the strings. As used herein, the terms "fret board" and "finger board" mean the portion of the instrument where the player's fingers press the strings to adjust tune regardless of the presence or absence of frets, and may be used interchangeably.

Referring now to the drawings wherein the showings are for purposes of illustrating embodiments of the invention only and not for purposes of limiting the same, FIG. 1A is a perspective view of a tune-stabilizing device 100 installed on a guitar. The tune-stabilizing device 100 is shown abutting the leading edge 110 of the guitar's fret board, which offsets the tune-stabilizing device 100 roughly a quarter inch from the nut 120 of the guitar. FIG. 1A also illustrates the proper orientation of the tune-stabilizing device 100 when installed on a guitar. Namely, the fine tuners face the nut of the guitar and the clamps face the tuning pegs or posts 130 of the guitar. Accordingly, as used herein, the side of the device facing the nut of a stringed instrument when properly installed is referred to as the fine tuner side 100A, and the opposing side which faces the tuners of the instrument is referred to as the clamping side 100B of the tune-stabilizing device 100.

Figure 1B:
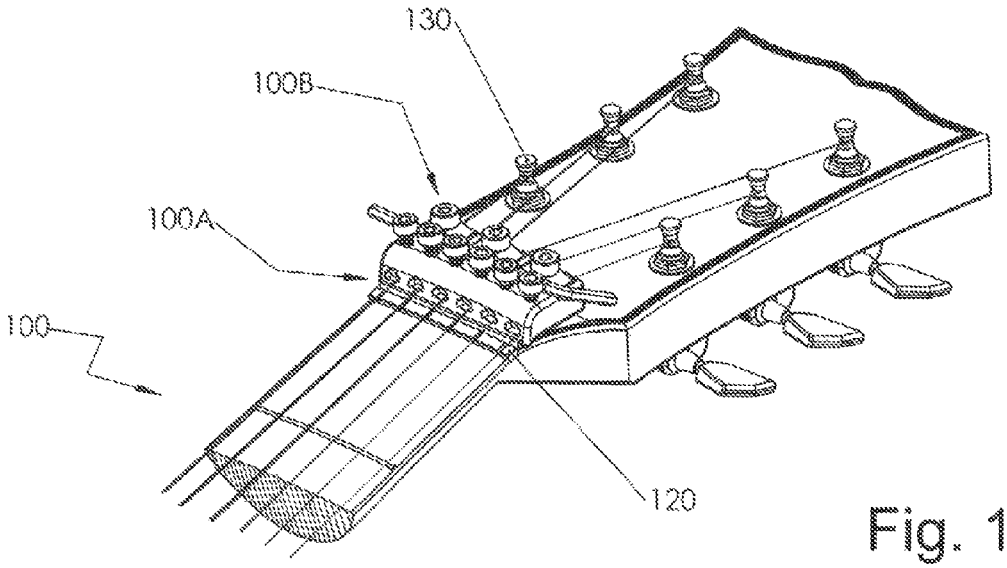
FIG. 1B is a perspective view of the present invention mounted against the nut of a guitar.

FIG. 1B shows another installation of a tune-stabilizing device 100 on a different style of guitar. In this case, the nut 120 of the guitar is at the leading edge of the fret board rather than being offset. Therefore, the tune-stabilizing device 100 abuts the nut 120 directly.

Figure 1C:
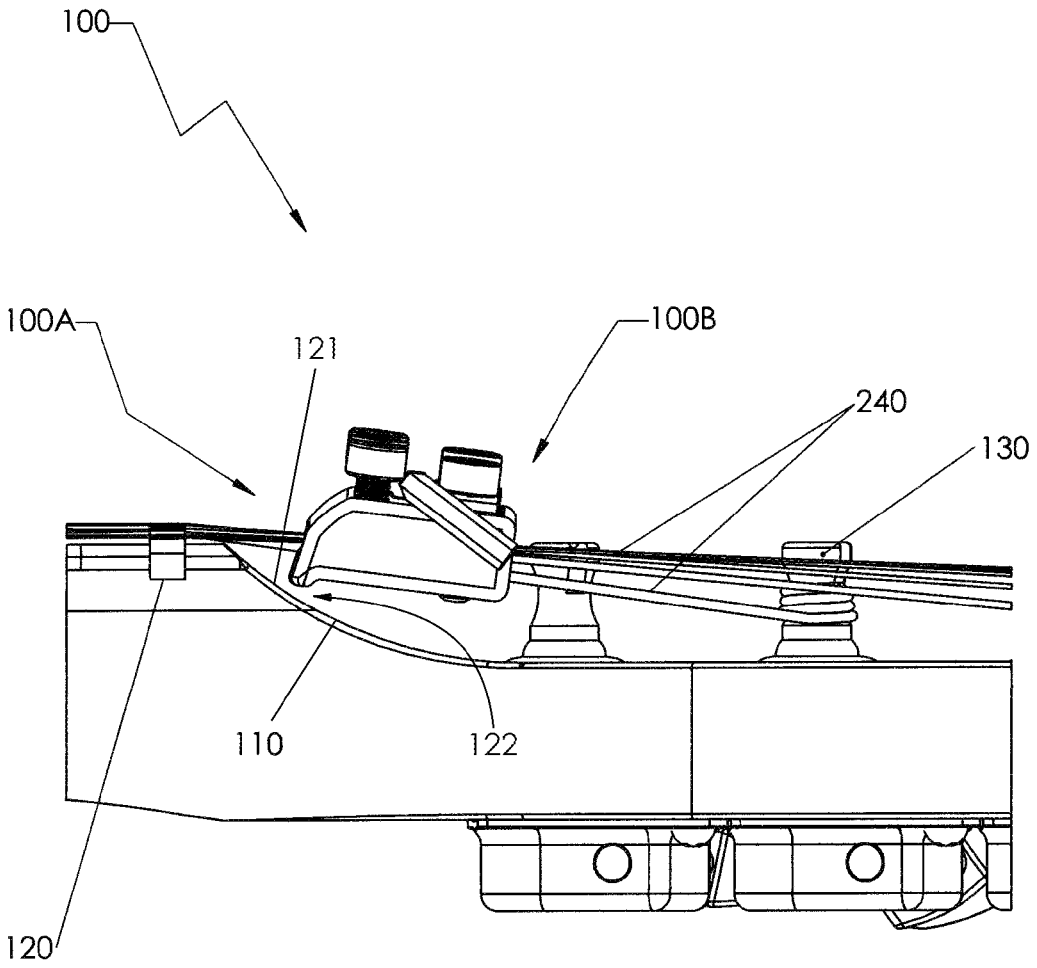
FIG. 1C is a side view of the present invention mounted on the strings of a guitar.

FIG. 1C shows another installation of the tune-stabilizing device 100 mounted entirely on the strings 240 of an instrument, such that the entire device does not contact the surface 121 of the instrument. As used herein, surface includes, but is not limited to, the neck, headstock, fret or finger board of the instrument. The tune-stabilizing device 100 is secured on the strings of a stringed instrument between the nut 120 and the tuning pegs 130, which leaves a gap 122 between the tune-stabilizing device 100 and the instrument surface 121.

Figure 2:
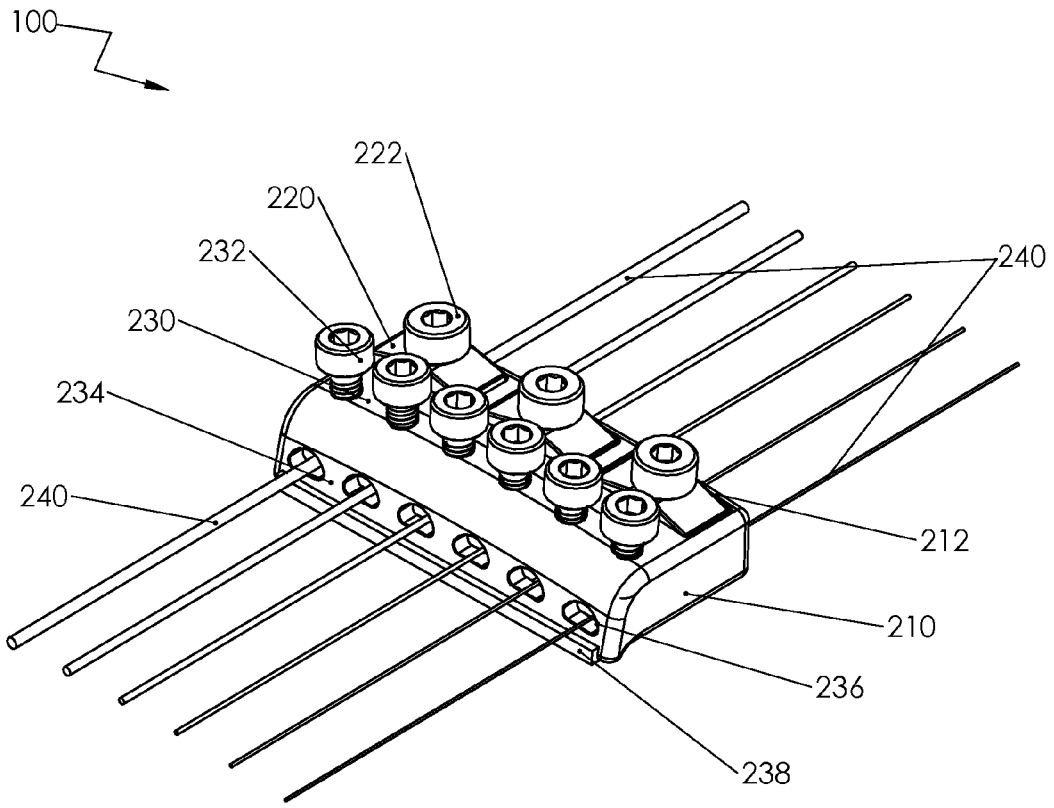
FIG. 2 is a perspective view drawing of the present invention.

FIG. 2 is a perspective view of a tune-stabilizing device 100 installed on a set of six precisely tensioned strings 240 of a six-stringed musical instrument. The tune-stabilizing device 100 includes a floating base plate 210 having three clamping blocks 220 for locking the tune-stabilizing device 100 onto the wires 240. The clamping blocks 220 are seated in recessed compression faces defining clamp seats, which are surrounded by a perimeter wall 212. One skilled in the art will appreciate that the clamp seats need not be recessed, but that recession may provide certain advantages related to aligning clamping blocks 220 during installation. The tune-stabilizing device 100 of FIG. 2 includes a set of three clamping blocks 220 which are each shown bolted to the floating base plate 210 with machine screws 222. Each clamping block 220 according to this particular embodiment clamps two of the tensioned wires 240 between the compression faces of the clamping block 220 and the floating base plate 210.

Also shown in FIG. 2 are a set of six fine-tuner screws 232 engaging female threads formed in the fine tuner plate 230, wherein each fine-tuner screw 232 impinges upon a single tensioned wire 240 in a side-on relation so as to enable fine adjustments to the wires' tension. The embodiment further includes an abutment wall 234 having a bumper 238 at its lower edge. The bumper functions as a cushion between the tune-stabilizing device 100 and a musical instrument to which it may be mounted, thereby protecting the instrument from scratches or other damage. The abutment wall 234 further includes a set of elongate apertures 236 through which the strings 240 pass. The specific size and configuration of the elongate apertures 236 may vary from one embodiment to the next, but in general they are sized to accommodate a variety of string spacings. Particularly, the elongate apertures 236 are positioned so that the embodiment 100 can be installed on a plurality of makes and models of guitar, each of which may position the strings slightly differently.

Figure 8:
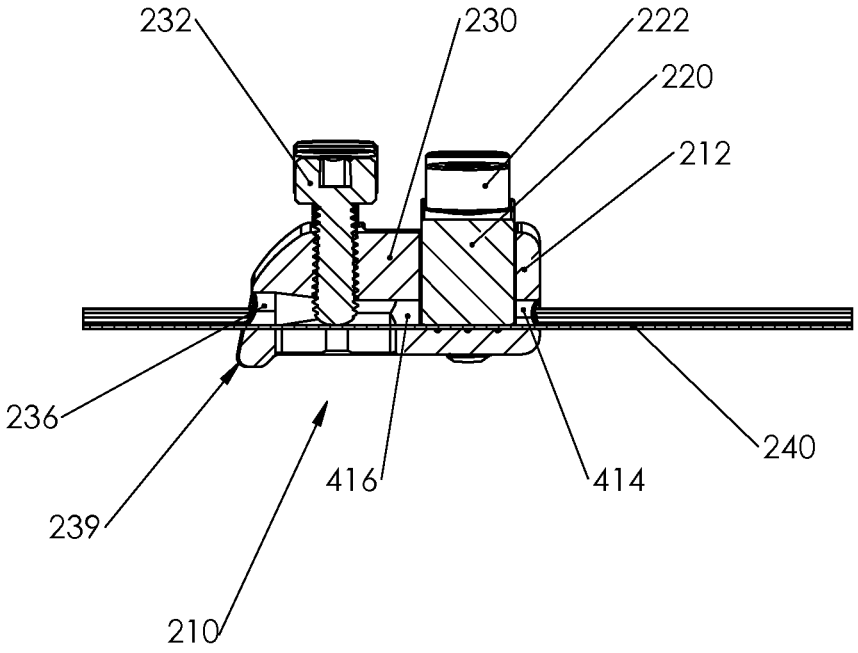
FIG. 8 is a side view of an alternate embodiment.

In another embodiment, the lower edge of the tune-stabilizing device 100 extends downwardly to an extended lip 239, as shown in FIG. 8. This optional extended lip 239 positions the device slightly further away from the nut, which in turn lowers the contact/abutment point on the nut or leading edge of a fret board and helps to prevent the device from riding up and over the nut or leading edge during heavy use in certain applications which otherwise could cause the strings to lift up from the nut creating an undesirable buzzing string sound. The extended lip 239 acts as a stop or brake, anchoring the device when it comes into contact with the leading edge of the fret board, when used in an arrangement with an instrument such as in FIG. 1A, as discussed above. The extended lip 239 acts as a stop or brake, anchoring the device against the nut, when used in an arrangement with an instrument such as in FIG. 1B, as discussed above. The angled lip 239 in conjunction with the downward tension of the strings helps in keeping the device from riding up along the leading edge of the fret board, and/or over the nut, and thus the device as a whole is limited in sliding further, which prevents the strings from lifting and dislodging from the nut. The lip 239 is also a guide for positioning the device during installation.

Figure 3:
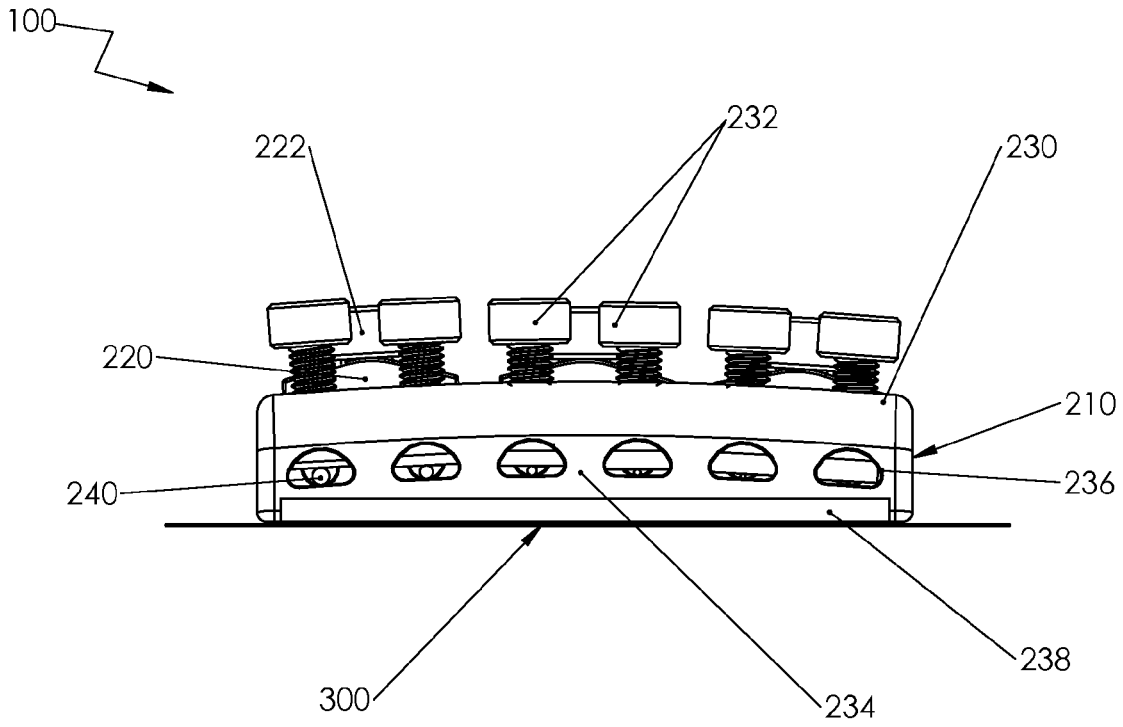
FIG. 3 is a fine tune side view of the present invention.

FIG. 3 is fine tuner side view of a tune-stabilizing device 100 illustrating the curvature 300 of the floating base plate 210. One skilled in the art will appreciate that such a curvature 300 may not be necessary but that it may be advantageous when an embodiment is to be installed on a stringed musical instrument where the strings lie in an arch or curved plane rather than a flat plane. Thus, the curvature 300 of the floating base plate 210 may approximately track the curvature or radius of the plane upon which the strings lie, so that a central axis of the apertures 236 through which the strings 240 pass generally align with a central axis of the respective strings 240 which are threaded through said apertures 236, wherein said arch matches the radius of the curvature of the fret or finger board of the instrument. The bottom of the base plate 210 can be straight, but the apertures 236 are aligned in an arch. Embodiments which include a floating base plate 210 having a curvature 300 may also provide clamping blocks 220 and/or fine-tuner plates 230 with similar and/or cooperating curvatures.

The present tune-stabilizing device 100 is floating, which, when installed on a stringed instrument, requires a deflection-arresting means. According to Newton's third law of motion, when the fine-tuners 232 press on the strings 240, the strings 240 press equally and oppositely against the fine-tuners 232, which would cause the device to deflect, rotate, or pivot upward, away from the strings, with the pivot point located at the internal apertures 416, which are near the clamping means 220. Each time a fine tuning knob is turned, the distal end, or the end of the device furthest from the pivot point 416, would deflect further, and the previous tuned strings would fall out of tune as a result of the deflection. This would lead to an iterative and tedious process of tuning one string, tuning another, then going back re-fine-tuning the previous strings. The apertures 236 of the tune-stabilizing device 100 function as a deflection-arresting means, engaging the strings and preventing the device from rotating or deflecting away from the strings. The through holes or apertures 236 prevent the tune-stabilizing device 100 from lifting or deflecting upwardly when the fine tuning screws 232 press against the strings 240. When the fine tuning screws press against the strings, the device will tend to deflect upward, pivoting at the internal aperture 416, but the bottom edge of the aperture 236 will contact the underside of the string 240, thus impeding the deflection, and keeping the distal end, and thus the whole device, in position. Subsequent fine tuning screws contacting the strings will not cause the previous fine-tuned strings to go out of tune as would happen absent the deflection arresting means.

As noted above, the shape of an aperture can vary, and can include, but is not limited to, an unbroken circle, and unbroken ellipse or oval, an unbroken semicircle or other unbroken oblong shape, an unbroken square or rectangle, an unbroken triangle or other unbroken polygon. As used herein, "unbroken" means a shape that has no gaps, cuts, openings, or other discontinuities in its perimeter.

Figure 2A:
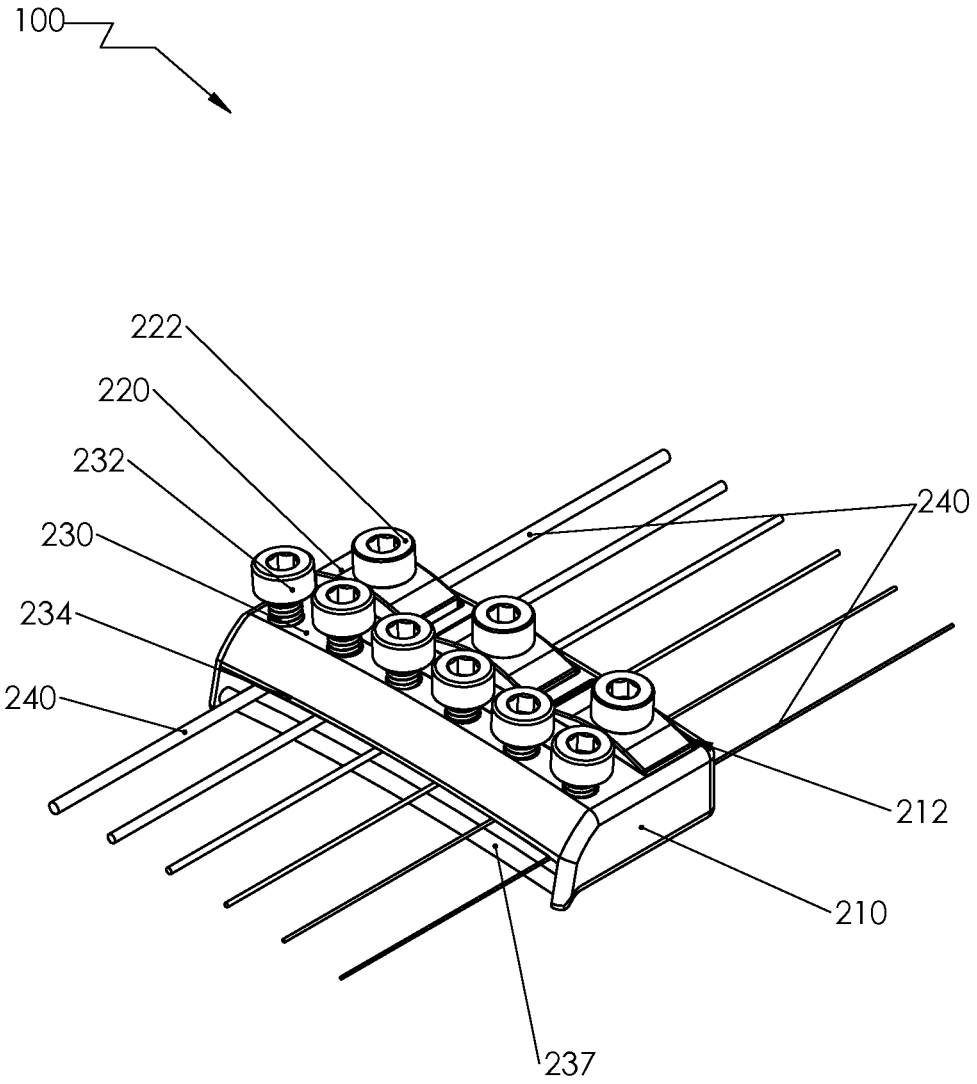
FIG. 2A is an alternate embodiment of the invention shown in FIG. 2.

The deflection arresting means is not limited to holes or apertures in a wall or surface. The deflection arresting means can be a surface, such as a bar 237, that is positioned beneath the strings 240, such the alternative embodiment shown in FIG. 2A. As the fine-tuner screws 232 are tightened, the tune-stabilizing device 100 will tend to rotate, but the anti-deflection bar 237 will contact the underside of the strings 240, preventing or arresting the rotation or deflection. This will keep the tune-stabilizing device 100 in place, and thus keep the instrument in tune. The exact shape of the anti-deflection bar 237 is not critical and can be round, like a cylinder; flat, like a plank; or faceted, like a polygonal prism, or combinations of these.

Figure 4A:
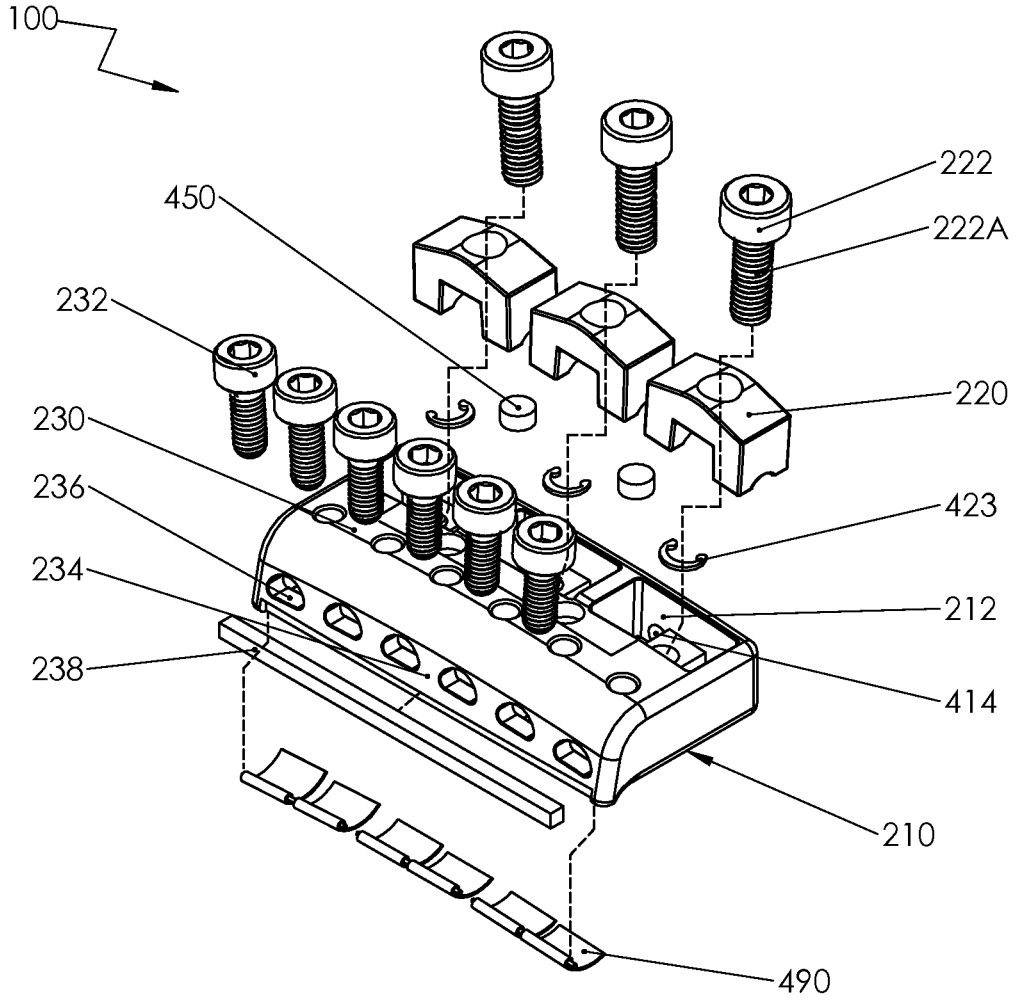
FIG. 4A is an exploded elevation view.

FIG. 4A is an exploded elevation view of tune-stabilizing device 100 showing the components thereof in greater detail. According to FIG. 4A the components of a clamping block assembly include a clamping block 220, a clamping screw 222 with a notch 222A which receives a clip 423. Thus, the clamping block 220 is retained on the clamping screw 222 by the clip 423 and moves in an upward direction as the clamping screw 222 is loosened. FIG. 4A also shows the placement of magnets 450, which are seated in apertures 550 in the fine turner plate 230 located between the fine tuner screws 232 and the clamping screws 222. FIG. 4A also shows a set of six optional shims 490, which can be positioned between the ends of the fine tuner screws 232 and the strings 240 as a means of reducing wear on the strings 240 by the turning action of the fine tuner screws 232. Finally, FIG. 4A shows one of a first set of apertures 414 where strings 240 enter the tune-stabilizing device 100.

Figure 4B:
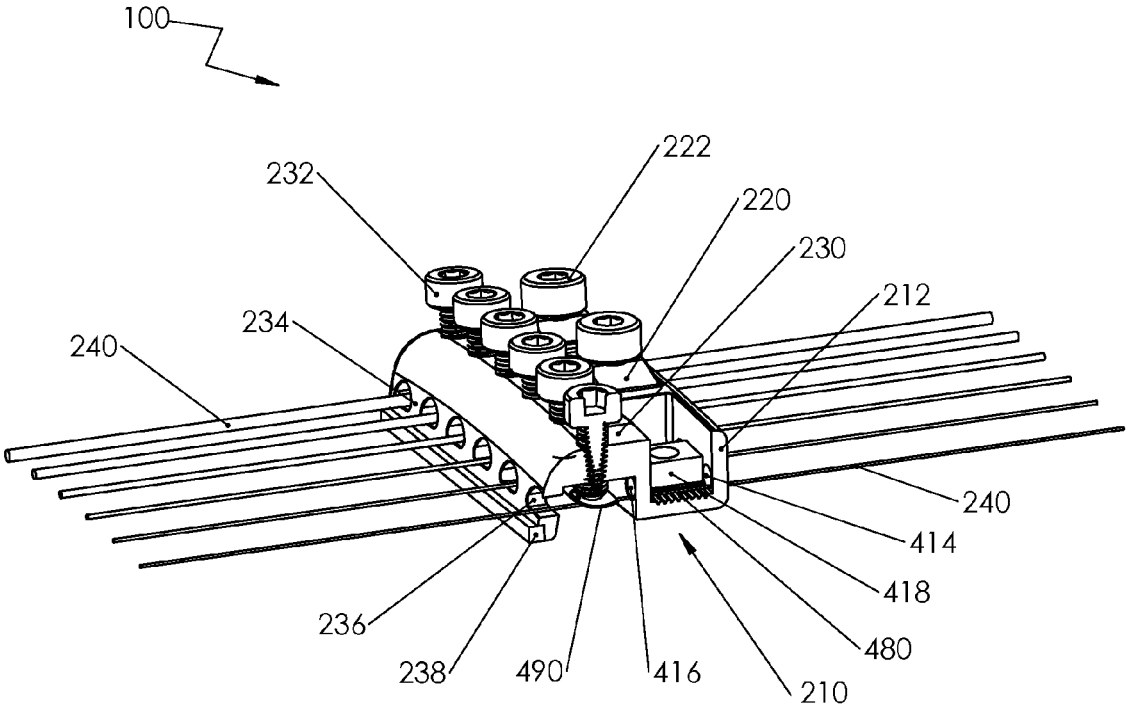
FIG. 4B is a cross sectional perspective side view showing the recessed compression face and fine tuners in more detail.

FIG. 4B shows the tune-stabilizing device 100 in cross section from an alternate angle and illustrates a first set of apertures 414 in a first section of the perimeter wall 212, and a second set of cooperating apertures 416 disposed on an opposing second section of the perimeter wall 212. The first and second sets of apertures 414, 416 are aligned such that the six strings 240 pass through cooperating apertures in a straight line. Furthermore, this view illustrates the fact that the respective central axes of the apertures 236, 414, 416 are aligned. Thus, a string 240 may be threaded through the embodiment 100 in a straight line, i.e. without bends. Also shown in FIG. 4B is the clamp seat 418 which receives the compression face of the clamping block 220. Accordingly, this view clearly illustrates how a clamping block affixes a tune-stabilizing device 100 to the strings 240. The particular clamp seat 418 shown in FIG. 4B includes optional texturing or knurling 480 to aid in gripping strings 240. FIG. 4B further illustrates the placement of optional shims 490. As shown, one edge of a shim 490 is attached to the underside of the tune-stabilizing device 100 so as to position it between the end of a fine tuner screw 232 and a string 240.

Figure 5:
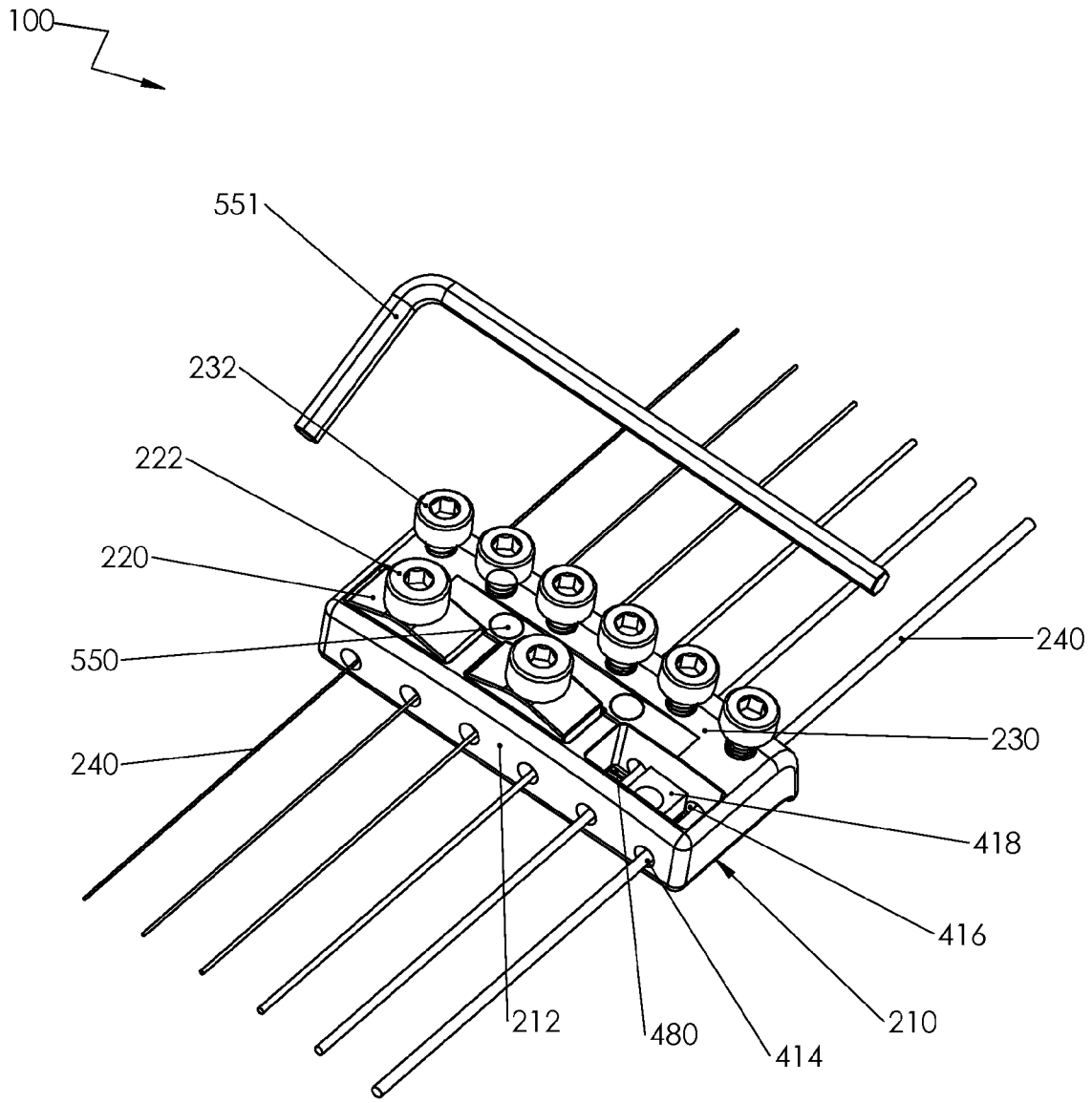
FIG. 5 is an elevation view showing placement of strings within the embodiment, and placement of a magnetically retained tool.

FIG. 5 is a perspective view of tune-stabilizing device 100 showing the placement of magnets 550 in the fine tuner plate 230 and how the magnets 550 receive an Allen wrench 551 or similar tool. Thus, the magnets 550 hold the tool 551 between the fine tuners 232 and the clamping screws 222.

Figure 6:
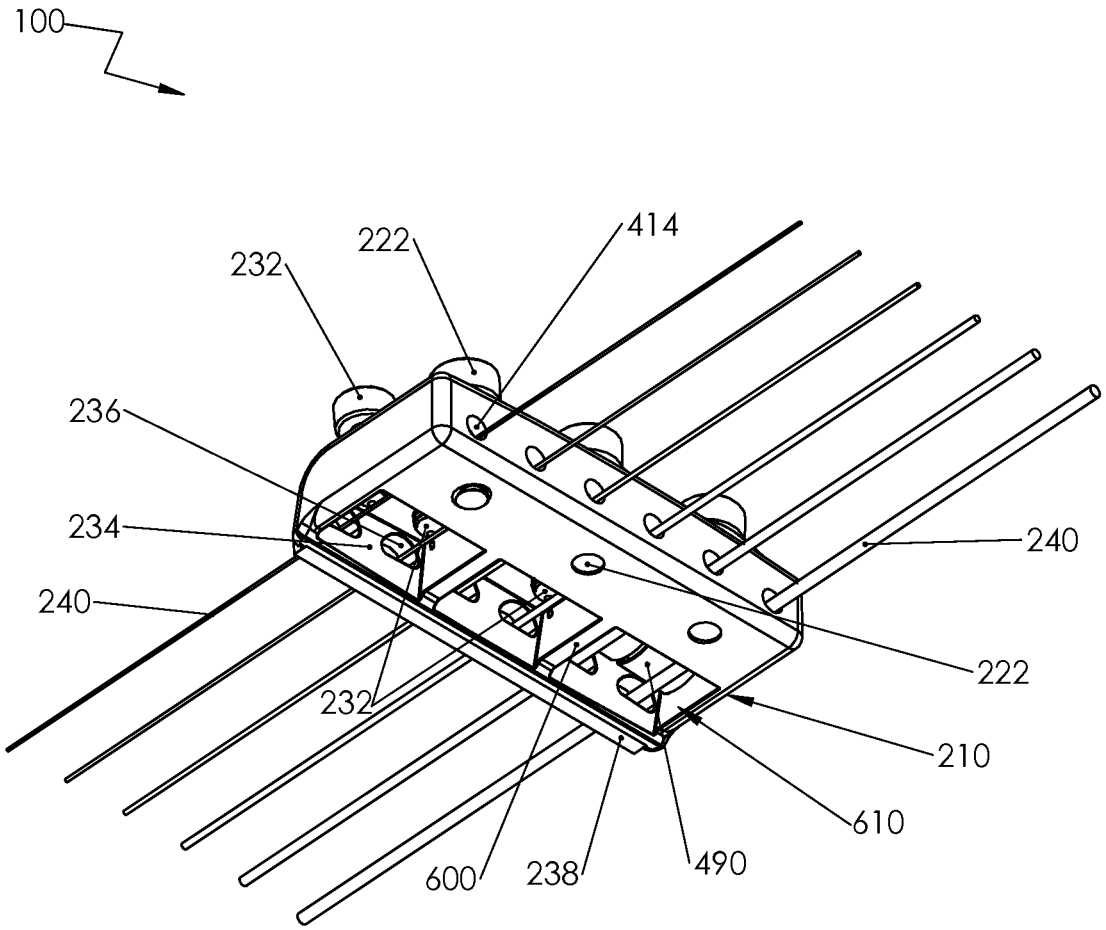
FIG. 6 is a perspective view from below.

FIG. 6 is a perspective view of an underside of tune-stabilizing device 100 which shows three fine-tuner cavities 610. The number of fine-tuner cavities is not critical, and can be one large cavity or six separate cavities as discussed below (see FIG. 6A). The three fine-tuner cavities 610 are separated from each other by reinforcing walls 600. The reinforcing walls 600 provide added strength to the abutment wall 234 which may prevent it from flexing under load. Also visible are the posts of the fine-tuner screws 232 which are shown impinging the tensioned strings 240 side-on. Such side-on impingement results in a controlled deflection of a tensioned string 240, thus finely adjusting its length and tension. Also visible in FIG. 6 are two optional shims 490. FIG. 6 shows four shims 490 are left out for the purpose of illustration only.

Figure 6A:
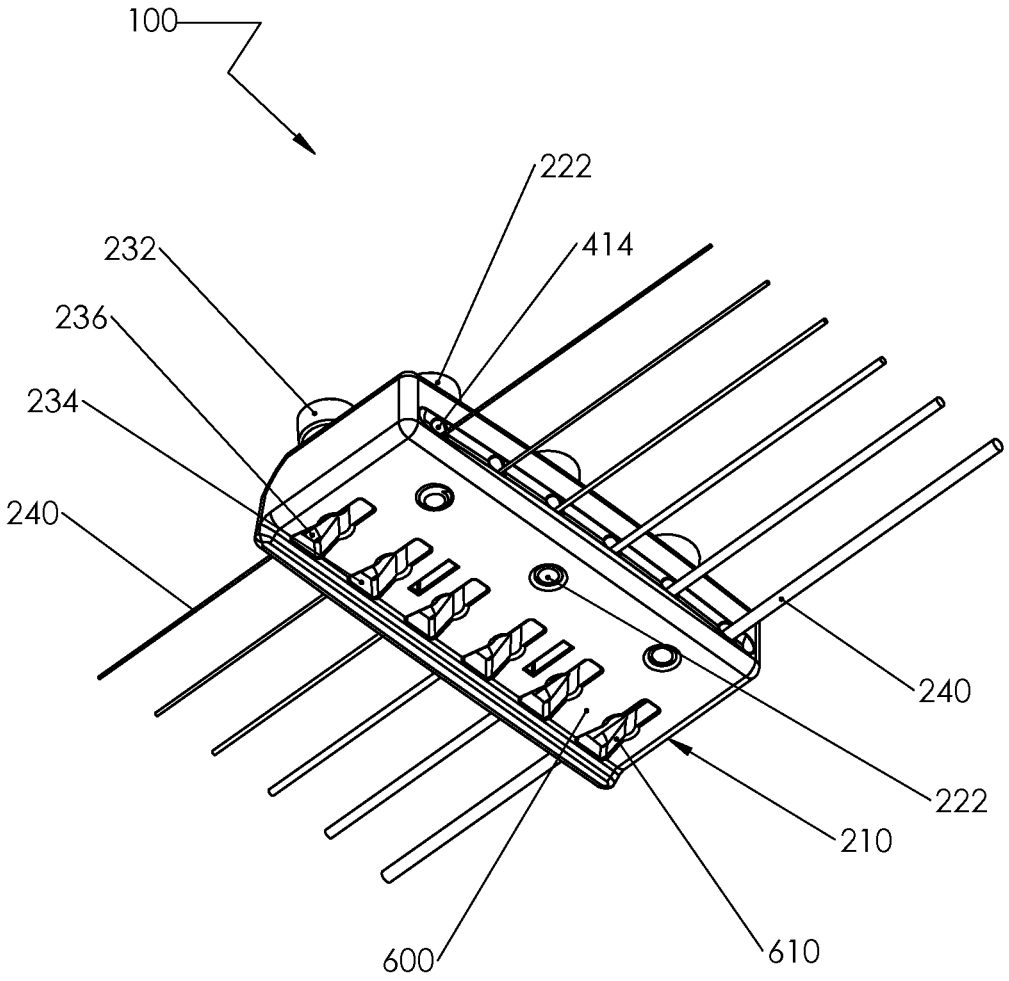
FIG. 6A is an alternate embodiment of the invention shown in FIG. 6.

FIG. 6A shows an alternate embodiment of the device with individual/separate cavities for each string. A tapered, fluted, or funnel shaped individual fine tuning cavity assists the string threading process in that it guides a string passing through the fine tuner cavity and entering into the clamp block cavity through outer clamp-end aperture 414. The cavity walls taper down to flank the fine tuner screw preventing a string 240 from slipping off of the end of the fine tuner screw 232 and around to its side, rendering the fine tuner screw ineffective.

Figure 7C:
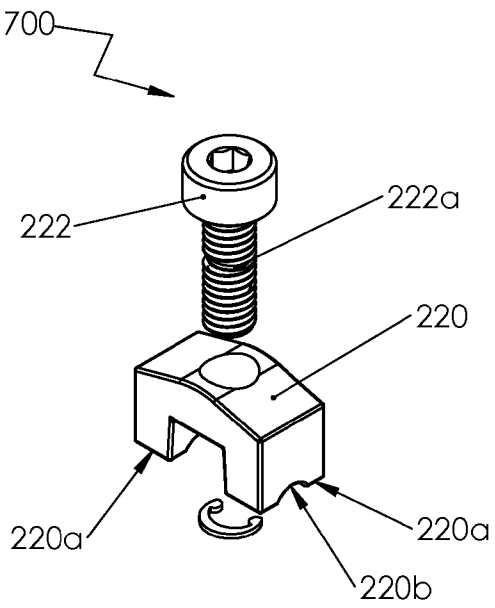
FIG. 7C is an exploded elevation view of a clamping block assembly.
Figure 7B:
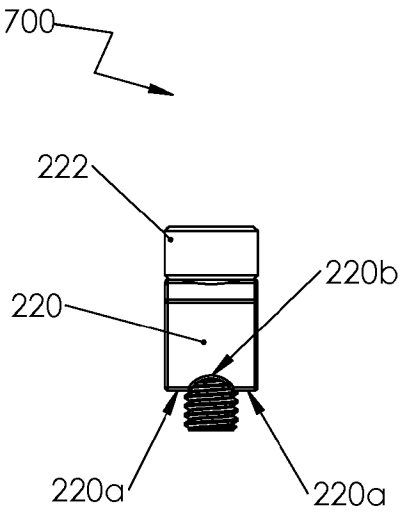
FIG. 7B is a side view of a clamping block assembly.
Figure 7A:
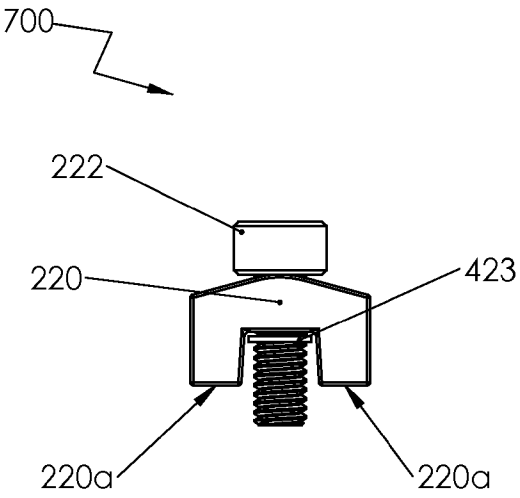
FIG. 7A is a front view of a clamping block assembly.

FIG. 7A illustrates a clamping block assembly 700 of an tune-stabilizing device 100. A clamping block assembly 700 may include a clamping block 220 and a clamping screw 222. The clamping block 220 is retained on the clamping screw 222 using a clip 423. Thus, the clamping block 220 is free to rotate about the clamping screw 222, as the clamping block moves away from the floating base plate 210 when the clamping screw 222 is loosened. This may be especially convenient when threading strings 240 through the embodiment 100, and may obviate the need for removing the clamping block 220 from the embodiment 100 thereby decreasing the risk of losing parts or improper reassembly. Also shown in FIG. 7A is the U-shaped design of the clamping block 220. This U-shaped configuration allows for a complementary relief between the compression faces 220*a* of the clamping block 220 and the compression face 418 of the floating base plate 210, which allows the compression screw 222 to have a larger number of threads in contact with the female threads of the floating base plate 210, thus mitigating the potential for stripping threads.

FIG. 7B is a side view of the assembly 700 which further illustrates that each of the two compression faces 220*a* of the clamping block 220 include an arch 220*b*. One skilled in the art will appreciate that while an arch may not be critical, it may tend to provide better clamping characteristics than a simply flat compression face. FIG. 7C shows the clamping block assembly 700 in an exploded view and further illustrates the notch 222*a* in which the e-clip 423 is retained.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

What is claimed is:

1. A tune stabilizing device comprising:

a string clamping means comprising a floating base plate and a clamping means adapted to cooperatively engage and releasably secure one or more instrument strings, a fine-tuning means, having a plurality of fine tuning screws in one-to-one correspondence with said instrument strings, whereby turning one of said screws presses on one of said strings, altering the tune of the string, and a deflection arresting means, capable of preventing said tune stabilizing device from deflecting away from the instrument strings when said fine tuning screws press against said strings, wherein said deflection arresting means comprises a series of apertures in a wall of said fine tuning means, wherein said apertures are in one-to-one correspondence with said instrument strings whereby said instrument strings pass through said apertures, such that each string is held by one of said clamping means and contacts an edge of one of said apertures, wherein one of said fine tuning screws engages the string at a point between said clamping means and said aperture.

2. The tune stabilizing device of claim 1, wherein when the tune stabilizing device is attached to said strings, said device is capable of maintaining the tune of the strings without contacting the neck or headstock of the instrument.

3. The tune stabilizing device of claim 1, wherein when placed on a stringed instrument having a nut and a plurality of tuning pegs, said floating base plate is capable of being secured on the strings of the instrument between the nut and plurality of tuning pegs, and is suspended by said instrument strings such that it contacts no part of the instrument apart from the strings.

4. The tune stabilizing device of claim 1, wherein said apertures are selected from the group consisting of unbroken circle, unbroken ellipse, unbroken semicircle, and combinations thereof.

5. The tune stabilizing device of claim 1, wherein said apertures define an arc tracking the curvature or radius of the neck of the instrument.

6. The tune stabilizing device of claim 1, further including at least one magnet adapted to anchor a tool to the device.

7. The tune stabilizing device of claim 6, wherein the at least one magnet is disposed between the fine-tuner screws and the string clamping means.

8. A tune stabilizing device for a stringed instrument having a nut, a fret or finger board, and a plurality of tuning pegs, comprising:

a floating base plate having a base compression face, and at least one female thread;

at least one clamping block having a block compression face adapted to mate with said base compression face, the clamping block including at least one unthreaded through-hole adapted to receive a screw therethrough, wherein the base and block compression faces are adapted to cooperatively engage a plurality of instrument strings;

at least one clamping screw adapted to be cooperatively received by one of the female threads of the floating base plate and one of the unthreaded through-holes of a clamping block so as to develop a compressive force between the base compression face and the block compression face, the compressive force being sufficient to fix the position of the tune-stabilizing device relative to the instrument strings; and a fine-tuner plate, having a plurality of female threaded apertures, each being adapted to receive a fine-tuner screw, wherein the female threaded apertures and the fine-tuner screws cooperate to engage the plurality of instrument strings in a tension-adjusting relation effected by turning the screws;

wherein said fine tuning plate is integral with said base plate and provides generally oblong apertures for said instrument strings to pass through said fine tuner plate, each of said oblong apertures having a bottom edge that is adapted to engage an underside of said instrument strings to prevent said floating base plate from deflecting when said fine-tuner screws engage said strings;

wherein said fine-tuner screws engage said stings at a point between said clamping screw and said oblong apertures;

wherein the device is capable of being secured to the strings between the nut or leading edge of the fret or finger board and the plurality of tuning pegs on an instrument without being secured or joined to the body or neck of the instrument.

9. The tune stabilizing device of claim 8, wherein said floating base plate is capable of abutting a nut of a stringed instrument.

10. The tune stabilizing device of claim 8, wherein said floating base plate further comprises a bumper that is capable of abutting a nut of a stringed instrument.

11. The tune stabilizing device of claim 8 further including an extended lip that engages leading edge of the fret or finger board and prevents said tune stabilizing device from riding up near the nut and dislodging the strings from the nut.

12. The tune stabilizing device of claim 8 further including an extended lip that engages the nut and prevents said tune stabilizing device from riding up over said nut and dislodging the strings from said nut.

13. A tune stabilizing device comprising:

a string clamping means comprising a floating base plate and a clamping means adapted to cooperatively engage and releasably secure one or more instrument strings, a fine-tuning means, having one or more fine tuning screws in one-to-one correspondence with said instrument strings, and a deflection arresting means, capable of preventing said tune stabilizing device from deflecting away from the instrument strings, wherein said deflection arresting means prevents said tune stabilizing device from deflecting away from the instrument strings when said fine tuning screws press against said strings, and wherein said screws press on one of said strings at a point between said clamping means and said deflection arresting means, whereby turning one of said screws alters the tune of the string, and wherein when placed on a stringed instrument having a nut and a plurality of tuning pegs, said floating base plate is capable of being secured on the strings of the instrument between the nut and plurality of tuning pegs, and is suspended by said instrument strings such that it contacts no part of the instrument apart from the strings.

* * * * *